US005624361A

United States Patent [19]

Lai

[11] Patent Number: 5,624,361

[45] Date of Patent: Apr. 29, 1997

[54] STRETCHING EXERCISER

[76] Inventor: Shu-Chiung Lai, No. 437, Ta-Sheng St., Nan-Tung Dist., Taichung, Taiwan

[21] Appl. No.: 688,187

[22] Filed: Jul. 29, 1996

[51] Int. Cl.[6] ..... A63B 21/04

[52] U.S. Cl. ..... 482/130; 482/137

[58] Field of Search ..... 482/130, 129, 482/121, 122, 123, 140, 111, 137

[56] References Cited

U.S. PATENT DOCUMENTS

| | | | |
|---|---|---|---|
| 4,600,196 | 7/1986 | Jones | 482/130 |
| 4,796,881 | 1/1989 | Watterson | 482/130 |
| 5,056,779 | 10/1991 | Webb | 482/137 |
| 5,094,449 | 3/1992 | Stearns | 482/137 |
| 5,094,450 | 3/1992 | Stearns | 482/130 |
| 5,256,126 | 10/1993 | Grotstein | 482/130 |

*Primary Examiner*—Lynne A. Reichard
*Attorney, Agent, or Firm*—Christie, Parker & Hale, LLP

[57] ABSTRACT

A stretching exerciser includes an elongated base with an upright prop. The prop has a top end formed with a forwardly extending limiting projection. A seat member is mounted on the base. A connector includes a horizontal lever portion with a front end, a rear end which is mounted pivotally on the top end of the prop, and a bottom side which abuts against the limiting projection on the prop when the connector pivots forwardly. The connector further includes a vertical lever portion and a pair of curved connecting plates. A backrest member includes an elongated connecting frame unit with a bottom end that is mounted pivotally to the connecting plates. The frame unit is provided with a limit plate, and the connecting plates abut against the limit plate to limit rearward pivoting movement of the backrest member relative to the base. A resistance cylinder is connected pivotally to the vertical lever portion of the connector and to the connecting frame unit of the backrest member to resist forward pivoting movement of the backrest member relative to the base. A handle unit is secured to a top end of the backrest member. A biasing unit interconnects the base and the connector to resist rearward pivoting movement of the backrest member.

9 Claims, 4 Drawing Sheets

STRETCHING EXERCISER

BACKGROUND OF THE INVENTION

1. Field of the Invention

The invention relates to an exerciser, more particularly to a stretching exerciser for performing forward and rearward stretching exercises.

2. Description of the Related Art

In this age of health consciousness, there is always a need to provide exercise equipments for stretching muscles to help alleviate physical problems, such as sore backs.

SUMMARY OF THE INVENTION

The object of the present invention is to provide a stretching exerciser for performing forward and rearward stretching exercises.

Accordingly, the stretching exerciser of the present invention comprises:

an elongated base having front and rear end portions and an intermediate portion which extends between the front and rear end portions, the intermediate portion having front and rear sections and an intermediate section between the front and rear sections, the rear section being formed with an upright prop, the prop having a top end formed with a forwardly extending limiting projection;

a seat member mounted on the front section of the intermediate portion of the base;

a connector including: a horizontal lever portion with a front end, a rear end which is mounted pivotally on the top end of the prop, and a bottom side which abuts against the limiting projection on the prop when the connector pivots forwardly; a vertical lever portion having a top end and a bottom end which is connected to the rear end of the horizontal lever portion; and a pair of curved connecting plates, each of which has a top end and a bottom end connected to the front end of the horizontal lever portion;

a backrest member including: an elongated connecting frame unit with a front side and a bottom end that is mounted pivotally to the top ends of the connecting plates, the frame unit being provided with a limit plate, the connecting plates abutting against the limit plate to limit rearward pivoting movement of the backrest member relative to the base; and a backrest cushion secured to the front side of the connecting frame unit;

a resistance cylinder having a first end connected pivotally to the top end of the vertical lever portion of the connector, and a second end connected pivotally to the connecting frame unit of the backrest member, the resistance cylinder providing resistance to forward pivoting movement of the backrest member relative to the base;

a handle unit secured to a top end of the backrest member; and a biasing unit which includes a number of elastic strips that interconnect the base and the connector to provide resistance to rearward pivoting movement of the backrest member relative to the base.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
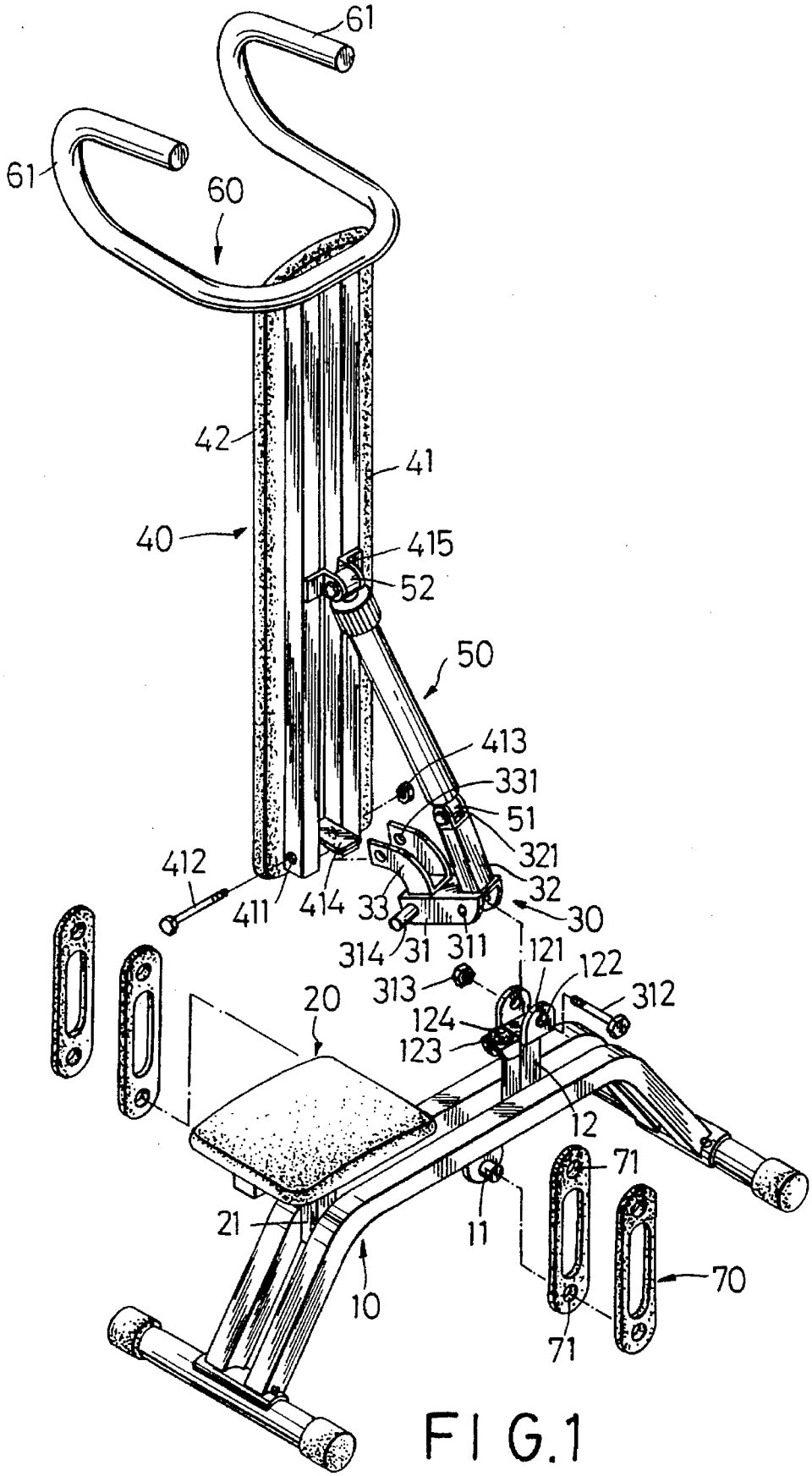
FIG. 1 is an exploded view of the preferred embodiment of a stretching exerciser according to the present invention.
Figure 2:
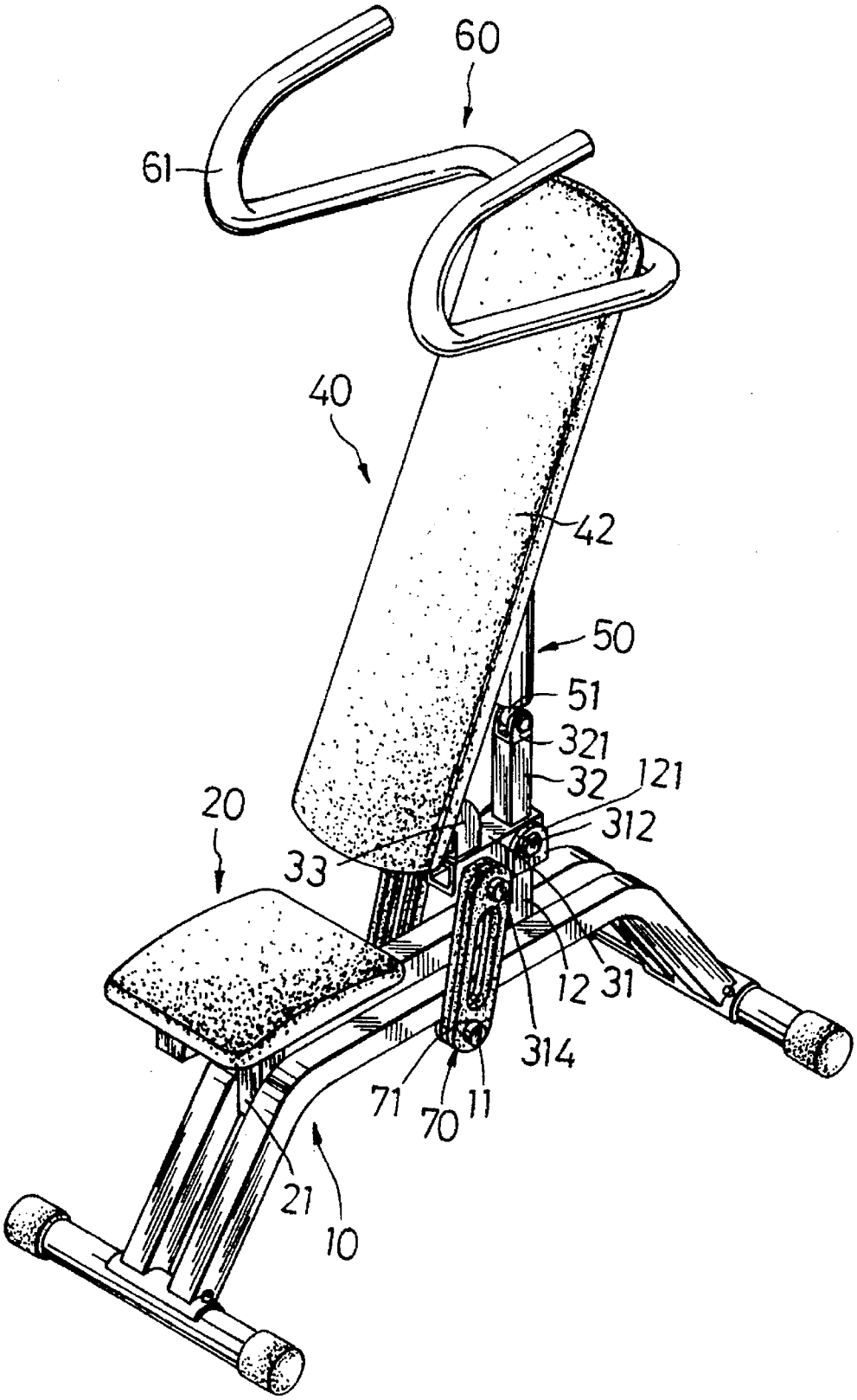
FIG. 2 is a perspective view of the preferred embodiment.

Referring to FIGS. 1 and 2, the preferred embodiment of a stretching exerciser according to the present invention is shown to comprise an elongated base 10, a seat member 20, a connector 30, a backrest member 40, a resistance cylinder 50, a handle unit 60 and a biasing unit which includes a number of elastic strips 70.

The base 10 has front and rear end portions and an intermediate portion which is generally inverted U-shaped and which extends between the front and rear end portions. The intermediate portion has front and rear sections and an intermediate section between the front and rear sections. The intermediate section has opposite sides formed with a respective first retaining pin 11. The rear section is formed with an upright prop 12. The prop 12 has a top end formed with a spaced pair of pivot plates 121 that are provided with aligned pivot holes 122. The top end of the prop 12 is further formed with a forwardly extending limiting projection 123. The limiting projection 123 has a top surface with a rubber cushion 124 secured thereon. Preferably, the cushion 124 has a top surface which is generally flush with bottom edges of the pivot plates 121.

The seat member 20 is provided with a downwardly extending mounting pin 21 for mounting the seat member 20 on the front section of the intermediate portion of the base 10.

The connector 30 includes a horizontal lever portion 31, a vertical lever portion 32 and a pair of curved connecting plates 33. The horizontal lever portion 31 has a rear end which is formed with a through hole 311 and which extends between the pivot plates 121 on the prop 12 of the base 10. A screw 312 extends through the pivot holes 122 in the pivot plates 121 and the through hole 311 in the horizontal lever portion 31 and engages a nut 313, thereby mounting pivotally the connector 30 on the top end of the prop 12. Preferably, the rear end of the horizontal lever portion 31 has a rounded bottom edge so that pivoting movement of the connector 30 will not be hindered by the prop 12. The bottom side of the horizontal lever portion 31 abuts against the cushion 124 on the limiting projection 123 when the connector 30 pivots forwardly. The horizontal lever portion 31 further has a front end with opposite sides that are formed with a respective second retaining pin 314. The vertical lever portion 32 has a bottom end connected to the rear end of the horizontal lever portion 31 and a top end formed with a spaced pair of pivot plates 321. Each of the connecting plates 33 has a bottom end connected to the front end of the horizontal lever portion 31 and a top end formed with a pivot hole 331.

The backrest member 40 includes an elongated connecting frame unit 41 having a bottom end formed with a pivot hole 411. A screw 412 extends through the pivot holes 331 in the connecting plates 33 and the pivot hole 411 in the connecting frame unit 41 and engages a nut 413, thereby mounting pivotally the backrest member 40 to the connector 30. The connecting frame unit 41 is provided with a limit plate 414 that is disposed above the pivot hole 411. The connecting plates 33 abut against the limit plate 414 to limit rearward pivoting movement of the backrest member 40 relative to the base 10. The connecting frame unit 41 is further provided with a spaced pair of pivot plates 415 at an intermediate portion thereof. A backrest cushion 42 is secured to a front side of the connecting frame unit 41.

In this embodiment, the resistance cylinder 50 is a hydraulic cylinder with a cylinder body 51 that is connected pivotally to the pivot plates 321 on the vertical lever portion 32 of the connector 30, and a work shaft 52 that is connected pivotally to the pivot plates 415 on the connecting frame unit 41 of the backrest member 40. The resistance cylinder 50 provides resistance to forward pivoting movement of the backrest member 40 relative to the base 10, as shown in FIG. 3.

The handle unit 60 is preferably an integrally formed metal member that is secured to a top end of the connecting frame unit 41 and that includes a spaced pair of forwardly extending C-shaped grip portions 61.

Figure 4:
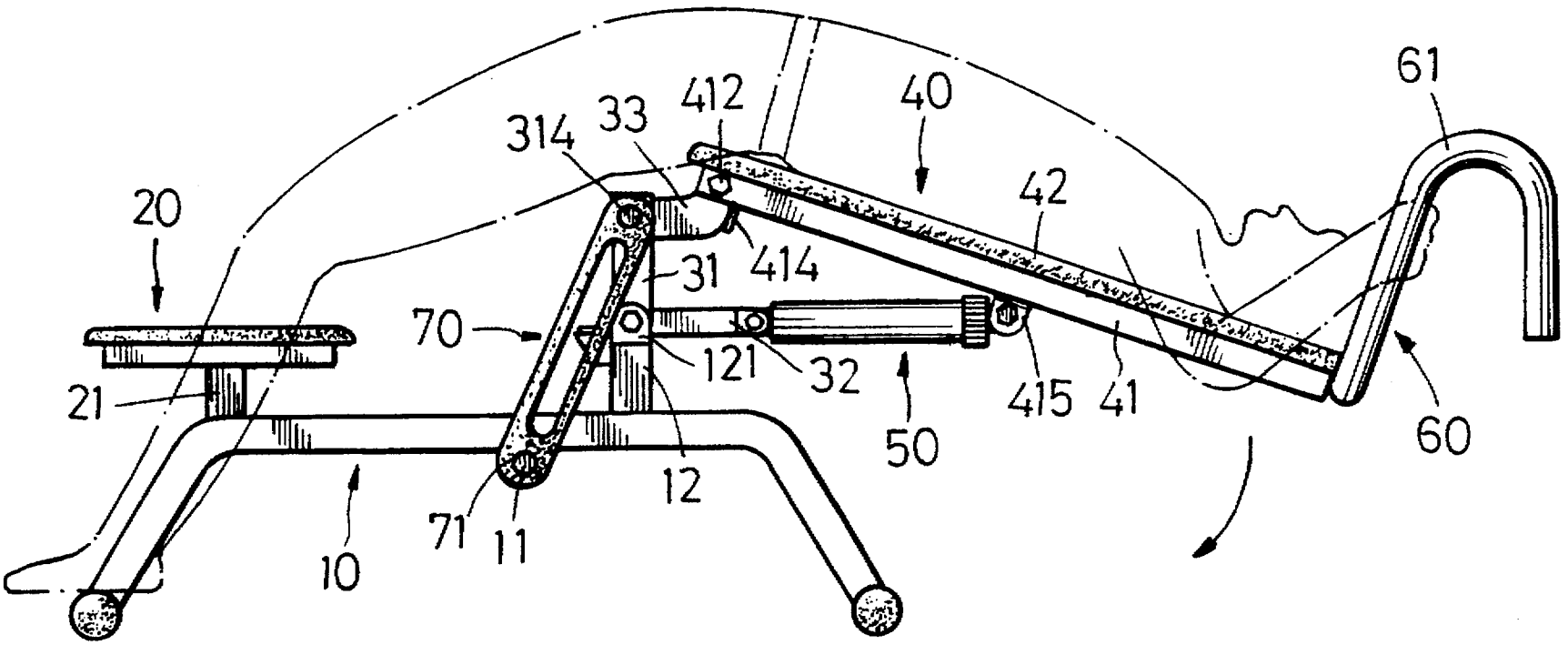
FIG. 4 is a schematic view illustrating the preferred embodiment when operated in a second exercising mode.

Each of the elastic strips 70 has two ends formed with a respective pin hole 71. The two ends of each elastic strip 70 respectively engage one of the first retaining pins 11 on the base 10 and one of the second retaining pins 314 on the connector 30. The elastic strips 70 provide resistance to rearward pivoting movement of the backrest member 40 relative to the base 10, as shown in FIG. 4. Moreover, the number of elastic strips 70 which interconnect the base 10 and the connector 30 may be varied to adjust the resistance to rearward pivoting movement of the backrest member 40.

Figure 3:
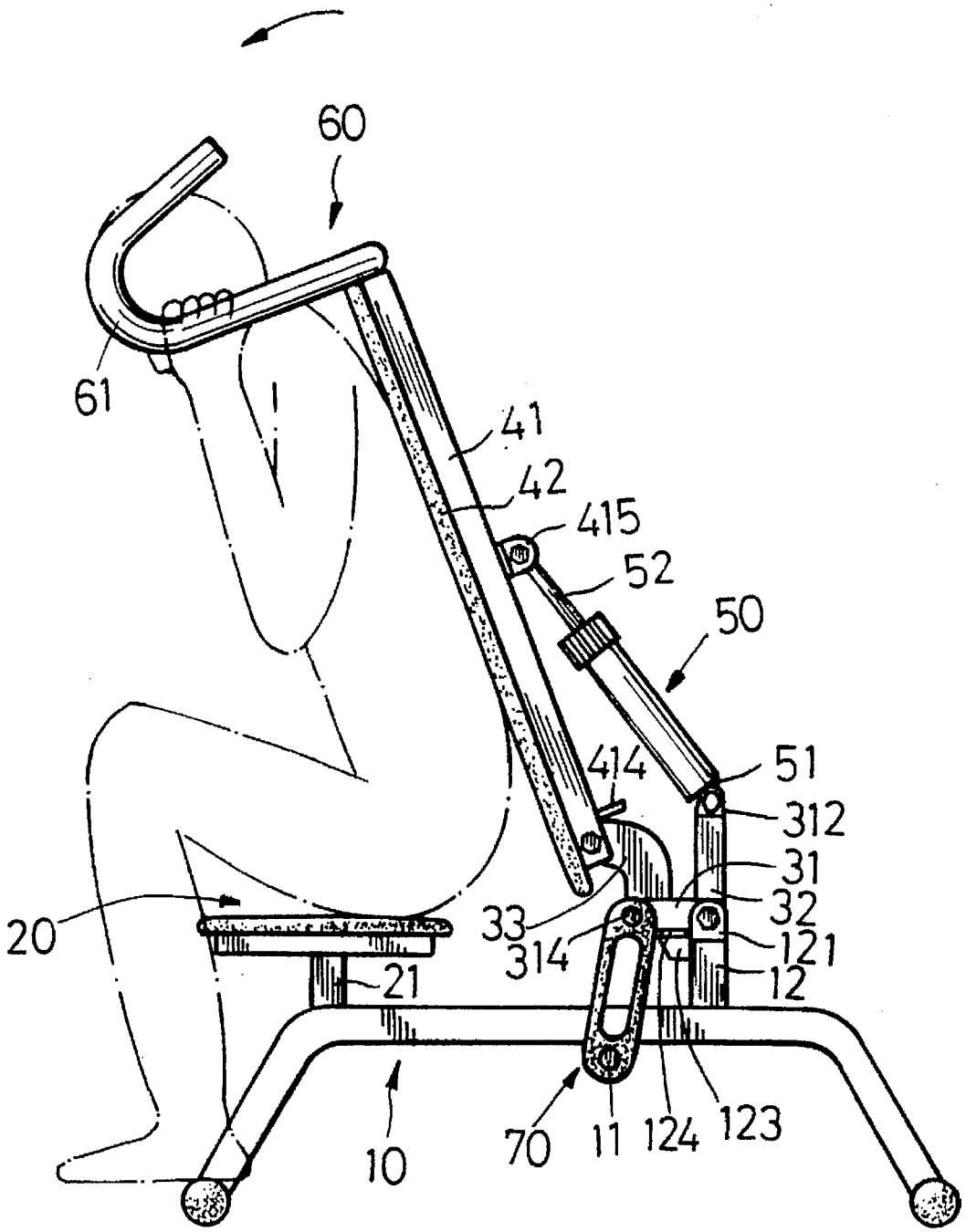
FIG. 3 is a schematic view illustrating the preferred embodiment when operated in a first exercising mode.

FIG. 3 illustrates the preferred embodiment when operated in a first exercising mode. As shown, the user is seated on the seat member 20 such that his back lies flat against the backrest member 40 and such that the two hands of the user grasp the grip portions 61 of the handle unit 60. The user then leans forward to cause forward pivoting movement of the backrest member 40 about the top ends of the connecting plates 33 of the connector 30. At this time, the bottom side of the horizontal lever portion 31 of the connector 30 abuts against the cushion 124 on the limiting projection 123 to minimize the noise and shock that are generated, and the prop 12 is disposed in a vertical position. Forward pivoting movement of the backrest member 40 results in a pulling action on the work shaft 52 of the resistance cylinder 50, thereby resulting in resistance to forward pivoting movement of the backrest member 40. When the user's arms are relaxed, the work shaft 52 retracts into the cylinder body 51 of the resistance cylinder 50 to return the stretching exerciser to its initial state. Use of the stretching exerciser in this mode results in exercising of the arms, neck, shoulders, back and waist of the user.

FIG. 4 illustrates the preferred embodiment when operated in a second exercising mode. As shown, the user forces the backrest member 40 to pivot rearwardly with the use of his back until the connecting plates 33 on the connector 30 abut against the limit plate 414 of the backrest member 40. Since the connecting plates 33 are connected integrally with the horizontal lever portion 31, movement of the connecting plates 33 results in corresponding pivoting movement of the horizontal lever portion 31 about the pivot plates 121 on the prop 12 such that the resistance cylinder 50 is disposed in a generally horizontal position. At this time, the second pins 314 on the connector 30 are moved to a maximum distance with respect to the first pins 11 on the base 10, thereby stretching the elastic straps 70 to result in resistance to rearward pivoting movement of the backrest member 40. When the user's back and waist are relaxed, the elastic straps contract to return the stretching exerciser to its initial state. Aside from exercising the back and waist of the user, use of the stretching exerciser in this mode also results in exercising of the arms, abdomen and legs of the user.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A stretching exerciser, comprising:

an elongated base having front and rear end portions and an intermediate portion which extends between said front and rear end portions, said intermediate portion having front and rear sections and an intermediate section between said front and rear sections, said rear section being formed with an upright prop, said prop having a top end formed with a forwardly extending limiting projection;

a seat member mounted on said front section of said intermediate portion of said base;

a connector including: a horizontal lever portion with a front end, a rear end which is mounted pivotally on said top end of said prop, and a bottom side which abuts against said limiting projection on said prop when said connector pivots forwardly; a vertical lever portion having a top end and a bottom end which is connected to said rear end of said horizontal lever portion; and a pair of curved connecting plates, each of which has a top end and a bottom end connected to said front end of said horizontal lever portion;

a backrest member including: an elongated connecting frame unit with a front side and a bottom end that is mounted pivotally to said top ends of said connecting plates, said frame unit being provided with a limit plate, said connecting plates abutting against said limit plate to limit rearward pivoting movement of said backrest member relative to said base; and a backrest cushion secured to said front side of said connecting frame unit;

a resistance cylinder having a first end connected pivotally to said top end of said vertical lever portion of said connector, and a second end connected pivotally to said connecting frame unit of said backrest member, said resistance cylinder providing resistance to forward pivoting movement of said backrest member relative to said base;

a handle unit secured to a top end of said backrest member; and a biasing unit which interconnects said base and said connector to provide resistance to rearward pivoting movement of said backrest member relative to said base.

2. The stretching exerciser as claimed in claim 1, wherein said intermediate portion of said base is generally inverted U-shaped.

3. The stretching exerciser as claimed in claim 1, wherein said biasing unit includes a number of elastic strips.

4. The stretching exerciser as claimed in claim 3, wherein:

said intermediate section of said intermediate portion of said base has opposite sides formed with a respective first retaining pin;

said front end of said horizontal lever portion of said connector has opposite sides formed with a respective second retaining pin; and each of said elastic strips has two ends formed with a respective pin hole for engaging one of said first retaining pins on said base and one of said second retaining pins on said connector.

5. The stretching exerciser as claimed in claim 1, wherein said rear end of said horizontal lever portion of said connector has a rounded bottom edge so that pivoting movement of said connector will not be hindered by said prop.

6. The stretching exerciser as claimed in claim 1, wherein said resistance cylinder is a hydraulic cylinder.

7. The stretching exerciser as claimed in claim 1, wherein said handle unit includes a spaced pair of forwardly extending C-shaped grip portions.

8. The stretching exerciser as claimed in claim 7, wherein said handle unit is an integrally formed metal member.

9. The stretching exerciser as claimed in claim 1, wherein said limiting projection has a top surface with a rubber cushion secured thereon to minimize noise and shock which are generated when said connector abuts against said prop.

* * * * *